United States Patent [19]

Ratledge

[11] 4,065,008

[45] Dec. 27, 1977

[54] REFUSE COLLECTION VEHICLES

[75] Inventor: Houston Ratledge, Maryville, Tenn.

[73] Assignee: Carrier Corporation, Syracuse, N.Y.

[21] Appl. No.: 711,834

[22] Filed: Aug. 5, 1976

[51] Int. Cl.[2] ..... B65F 3/00

[52] U.S. Cl. ..... 214/83.3; 214/152

[58] Field of Search ..... 214/83.3, 503, 82, 152

[56] References Cited

U.S. PATENT DOCUMENTS

| | | | |
|---|---|---|---|
| 3,615,028 | 10/1971 | Appleman et al. | 214/83.3 |
| 3,696,951 | 10/1972 | Toppins et al. | 214/83.3 |

*Primary Examiner*—Robert G. Sheridan

*Attorney, Agent, or Firm*—Burns, Doane, Swecker & Mathis

[57] ABSTRACT

A refuse collection vehicle has a rear hopper, an inlet for introducing refuse into the hopper, an outlet for discharging refuse from the hopper, and a refuse compacting assembly. A manual actuable power system is provided for displacing the compacting assembly through a loading cycle wherein refuse in the hopper is compacted and discharged from the hopper. Mechanism is provided for automatically deactivating the power system in response to the compacting assembly reaching a predetermined point in the cycle, to interrupt the cycle. A manually actuable handle is provided for activating the power system to initiate the loading cycle, and for reactivating the power system to continue the loading cycle subsequent to interruption thereof by the automatic deactivating mechanism.

13 Claims, 11 Drawing Figures

FIG. 1.
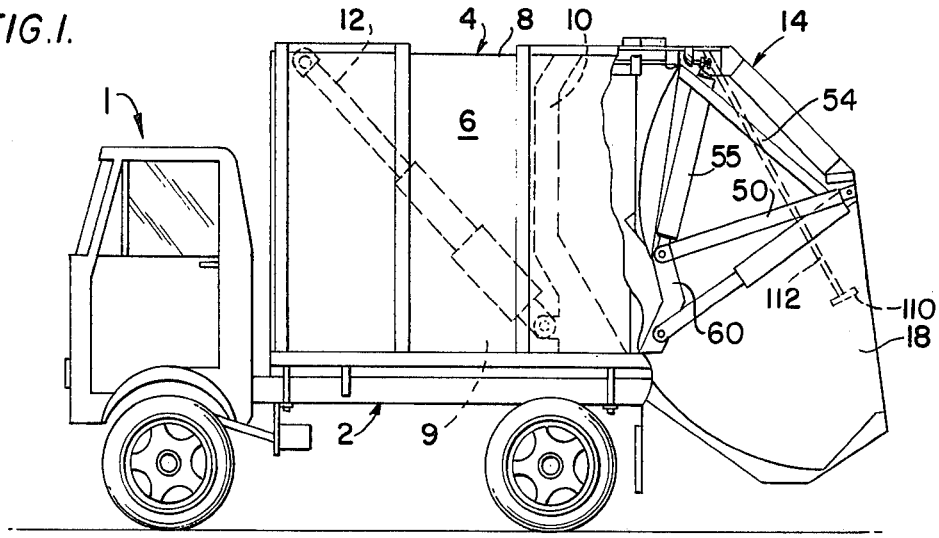
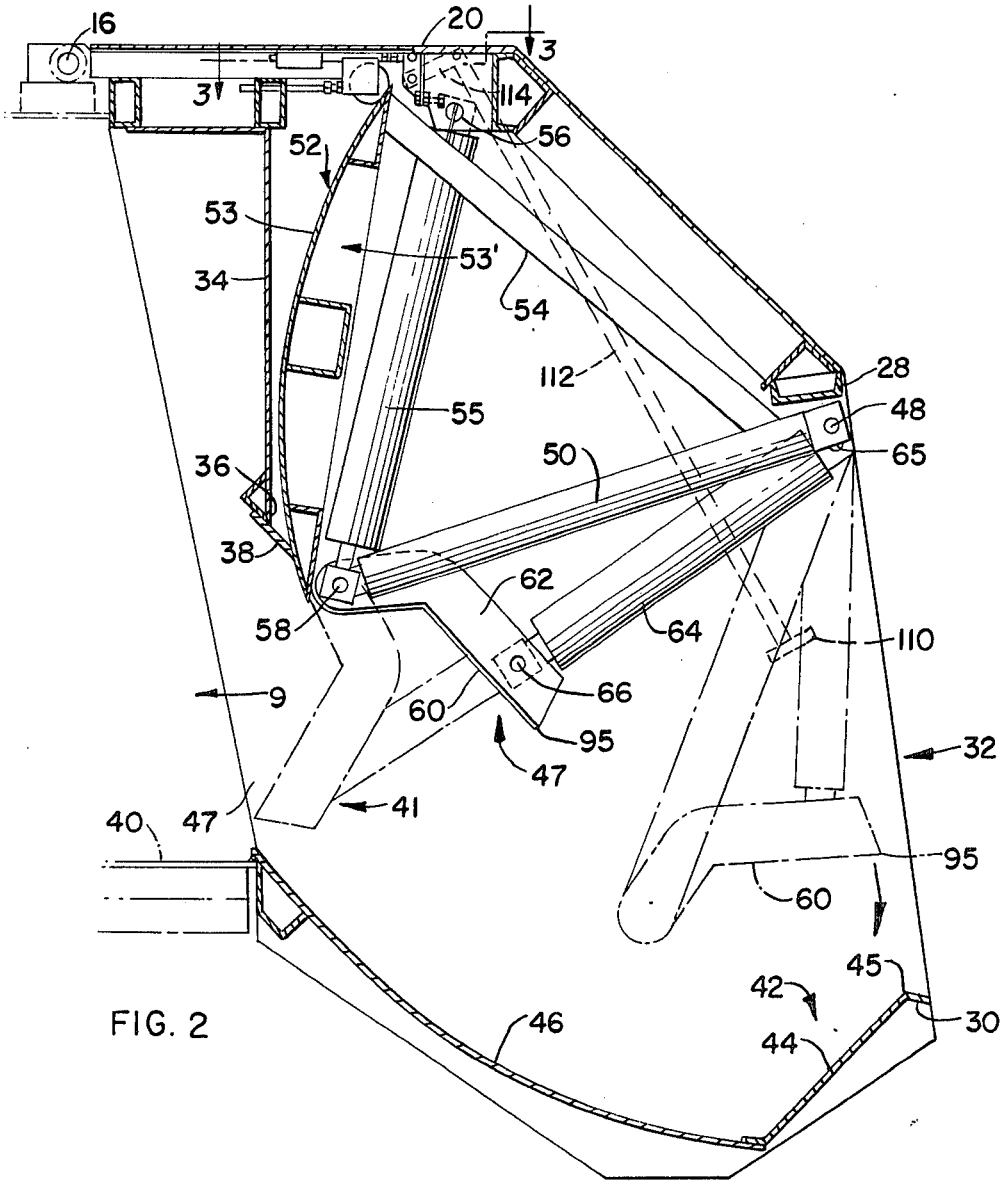
FIG. 2

REFUSE COLLECTION VEHICLES

BACKGROUND ANB OBJECTS OF THE INVENTION

The present invention involves refuse collection vehicles and, more particularly, relates to rear end loaders.

Rear end refuse loaders typically include a rear tailgate containing a rearwardly open hopper for receiving refuse. Refuse is collected by workmen who dump the refuse over a rear edge or sill of the hopper. A packer mechanism is mounted for displacement within the tailgate. A power system displaces the packer mechanism through a loading cycle to compact and load refuse into a storage compartment of the vehicle. Attention is directed to commonly assigned Toppins et al. U.S. Pat. No. 3,696,951, issued Oct. 10, 1972 for a more detailed description of such a rear end loader. The disclosure of that patent is incorporated herein by reference as it set forth at length.

The loading cycle is usually initiated by manual actuation of a handle located at a side of the vehicle. During the loading cycle the packer mechanism passes downwardly across the rear edge of the hopper. This is a critical period from a safety standpoint in that serious injury can be inflicted upon inattentive or careless workmen. For example, in the event that a workman attempts to deposit refuse into the hopper during this critical period, there is a danger that part of his body may become caught between the packer mechanism and the hopper rear edge. Systems have previously been proposed for interrupting a fluid powered refuse loading cycle, but such systems rely upon pressure build-ups in the fluid circuitry and do not assure that interruption will occur before the packer mechanism has traversed the hopper rear edge.

It is, therefore, an object of the present invention to enhance the safety of rear end refuse loaders.

It is another object of the present invention to interrupt the loading cycl prior to the critical period wherein the packer mechanism passes acros the rear edge of the hopper.

It is yet another object of the invention to prevent continuation of the loading cycle in the absence of subsequent manual activation by a workman.

SUMMARY OF THE INVENTION

These objects are achieved by the present invention which involves a refuse collection vehicle having a rear hopper, an inlet for introducing refuse into the hopper, an outlet for discharging refuse from the hopper, and a refuse compacting assembly. A displacing system is provided for displacing the compacting assembly through a loading cycle wherein refuse in the hopper is compacted and discharged from the hopper. Mechanism is provided for automatically deactivating the displacing system in response to the compacting assembly reaching a predetermined point in the cycle. A manually actuable mechanism is provided for reactivating the displacing system to continue the loading cycle subsequent to interruption thereof by the automatic deactivating mechanism.

THE DRAWINGS

Advantages of the present invention will become apparent from the subsequent description thereof in connection with the accompanying drawings in which like numerals designate like elements, and in which:

FIG. 1 is a side elevational view of a refuse loader incorporating a preferred embodiment of the present invention;

FIG. 2 is a vertical cross sectional view of the tailgate portion of the vehicle, with the loading mechanism shown in various positions of operation;

Figure 3:
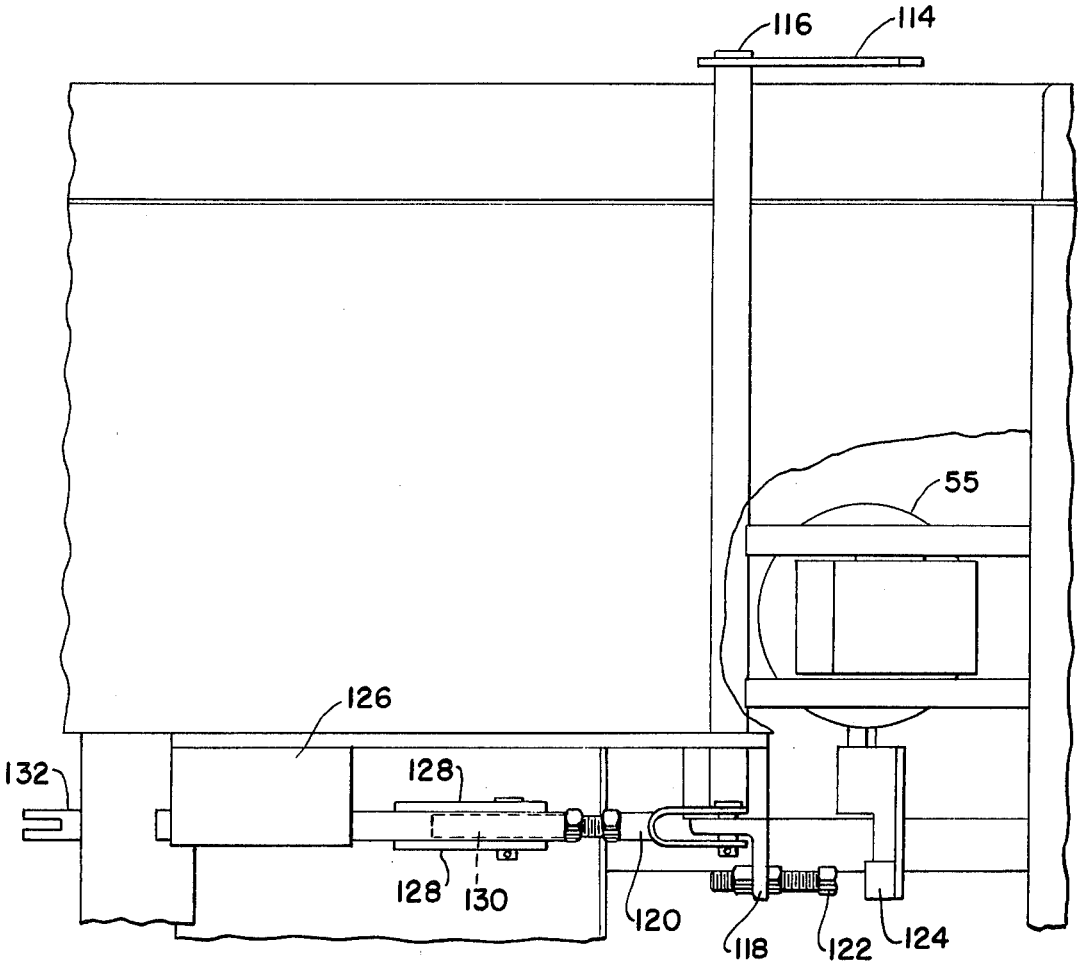
FIG. 3 is a cross-sectional view of the tailgate portion taken along line 3—3 of FIG. 2 and showing the control linkage.
Figure 5A:
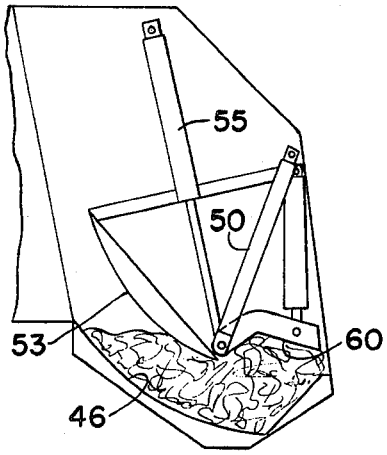
Figure 5B:
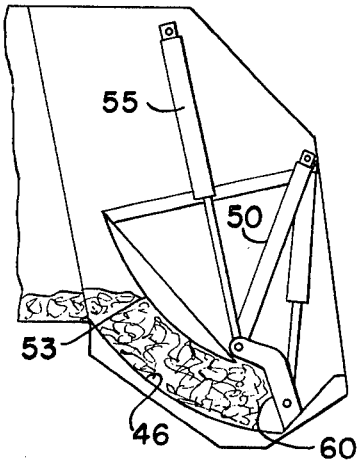
Figure 5C:
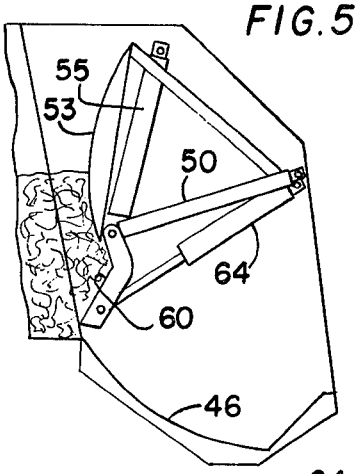
Figure 6:
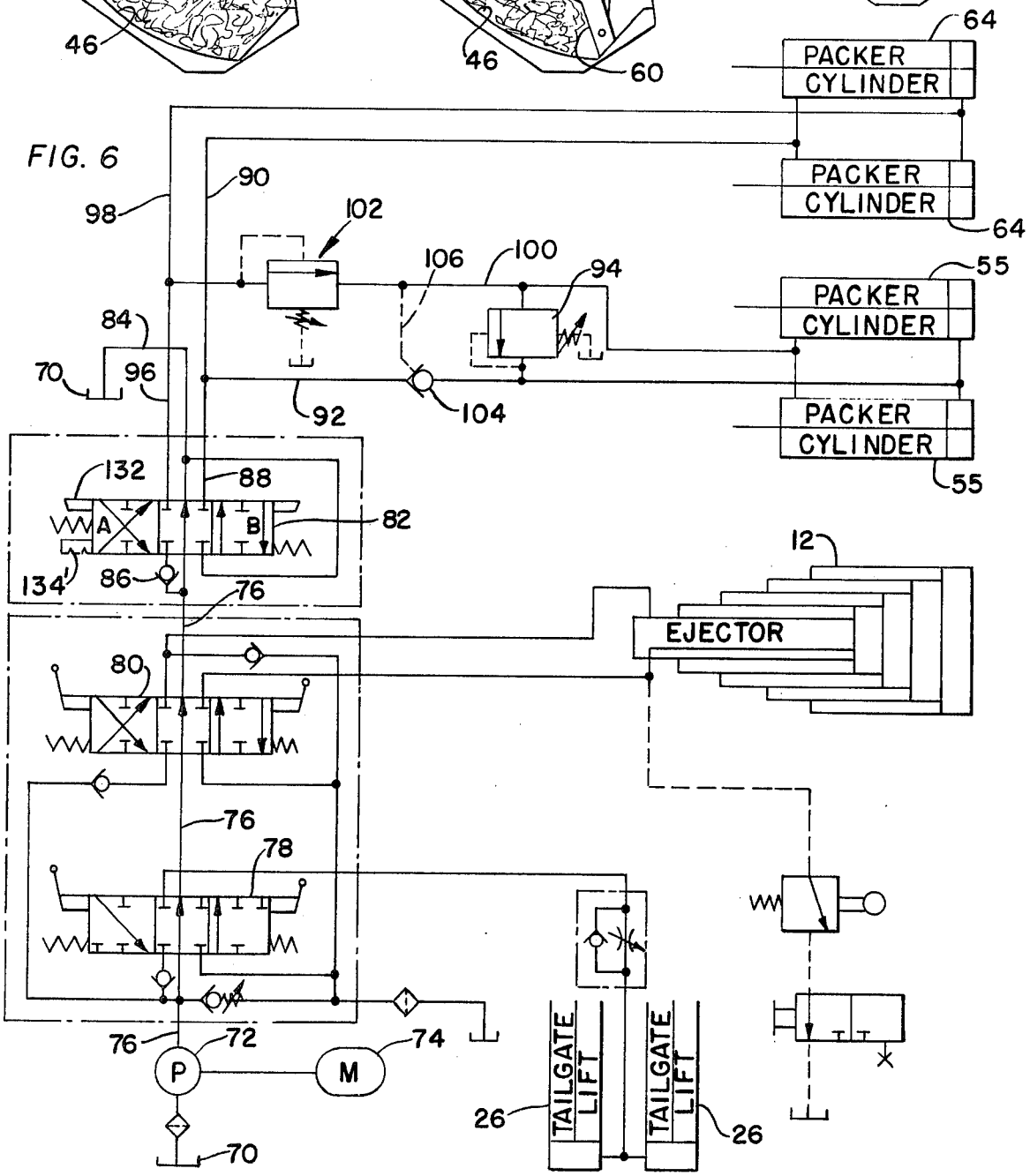

FIGS. 4'a–4*d* are cross-sectional views of the tailgate portion taken along the line 4—4 in FIG. 3 and showing the control linkage in various stages of actuation;

FIGS. 5*a*–5*c* are schematic views depicting the orientations assumed by the loading mechanism during various stages of a refuse loading cycle; and FIG. 6 is a schematic view of a hydraulic circuit which operates the loading mechanism.

DETAILED DESCRIPTION OF A PREFERRED EMBODIMENT

A rear loader vehicle incorporating a preferred embodiment of the present invention includes a cab 1 containing an engine, and a chassis 2 on which a refuse body 4 is secured. The body 4 has opposite side walls 6 and a top wall 8, which define a refuse-storing compartment 9. These walls are suitably braced to resist deflection due to the pressures exerted by the contents of the compartment.

An ejector plate 10 is mounted in the interior of the body 4 for reciprocating movement between front and and rear positions. The ejector plate 10 is shown in the rear position in FIG. 1. The ejector plate extends across the full width of the body 4 between the side walls 6 and between the top 8 and the bottom of the body 4. Thus the ejector plate forms a movable front wall for the body 4. A telescoping hydraulic ram 12 extends between a bracket on the top 8 of the body and a bracket at the bottom of the ejector plate 10. Extension of the ram 12 displaces the ejector plate 10 toward the rear of the body 4, while retraction of the ram 12 displaces the ejector plate toward the front of the body.

A tailgate assembly 14 is mounted on hinges 16 at the rear of the body 4. The tailgate assembly 14 has side walls 18 and a top 20. The side walls 18 are spaced apart approximately the same distance as the side walls 6 of the body, so that the tailgate assembly 14 forms a closure of the rear end of the body 4.

A pair of hydraulic rams 26 (FIG. 6) are connected between the body 4 and the tailgate assembly 14 in conventional manner. Extension of such cylinders causes the tailgate assembly 14 to swing vertically about the hinges 16 for dumping the contents of the body 4 as the ejector plate 10 is displaced rearwardly.

The tailgate assembly 14 includes a transverse beam 28 and a transverse sill 30 extending between the side walls 18 (FIG. 2). A refuse receiving opening 32 at the rear of the tailgate assembly 14 is bounded by the beam 28, the sill 30, and the side walls 18. The tailgate assembly 14 also includes a front wall 34 that extends downwardly from the top 20 and across the width of the assembly between the side walls 18, and terminates in a transverse edge 36 along which a scraper bar 38 is attached.

A hopper 42 is established in the bottom of the tailgate assembly 14. The hopper includes a rear support surface 44 and a front support surface 46. The surfaces 44 and 46 extend across the width of the tailgate assembly transversely of the vehicle. The rear surface 44 is curved downwardly from an edge 45 of the sill 30 and the front surface 46 is curved upwardly from the rear surface 44 to the bottom 40 of the body. The front surface terminates in an edge 47' that projects through a discharge opening 41 situated between the edge 36 of the wall 34 and the vehicle bottom 40. The discharge opening 41 communicates the hopper 42 with the interior compartment 9 of the vehicle body. The edge 47' of the surface 46 projecting up within the compartment 9 assists in holding trash inside the compartment. The scraper bar 38 mounted on the lower edge 36 of the front wall 34, projects rearwardly through the opening 41.

A loading assembly 47 is mounted in the tailgate 14 (FIG. 2). This loading assembly includes a pair of arms 50 which are pivotally mounted on shafts 48 adjacent each side wall 18. A rigid panel 52 extends between the side walls 18 and is supported at opposite ends on the arms 50. The panel 52 has a curved forward surface preferably formed by a curved shield plate 53 secured upon a skeleton frame 53'. A brace 54 extends between each arm 50 and the upper edge of the panel. Thus, the panel 52 is fixed relative to the arms 50 and swings in an arc about the shafts 48.

The scraper plate 38 is oriented for wiping engagement with the plate 53 as the latter is displaced in a manner to be subsequently described.

The position of the panel 52 is controlled by a hydraulic ram 55 mounted adjacent each arm 50. Each ram 55 is pivotally mounted at one end on the top wall 20 by a pin 56, as shown in FIG. 4*a*. A shaft 58 is mounted at the lower edge of the panel 52 adjacent each end of the panel. The end of the piston rod of each ram 55 is pivotally secured on a respective shaft 58. Extension of the pistons in the rams 55 causes the panel 52 to swing downwardly from the position shown in FIG. 2 to the position shown in FIG. 5*a*.

A packer plate 60 extends across the tailgate assembly 14 between the side walls 18 and is mounted on a skeleton frame 62 that is suspended for swinging movement on the respective shafts 58. The axis of the shafts 58, about which the plate 60 and frame 62 swing relative to the panel 52, is parallel to the axis of the shafts 48. The piston rod of each ram 64 is pivotally secured to the supporting frame 62 of the plate 60 by a pin 66. Retraction of the pistons in the rams 64 swings the plate 60 upwardly from the position shown in FIG. 5*c* to the position shown in FIG. 2.

Movement of the shield plate 52 and the packer plate 60 is controlled by a hydraulic circuit shown schematically in FIG. 6. This circuit includes a fluid reservoir 70, and a pump 72, which is driven by a motor 74. A main conduit 76 conducts pressurized fluid from the pump to a plurality of spool valves 78, 80 and 82.

The first valve 78 is manually actuable for diverting fluid to the tailgate lift rams 26. The second valve 80 is arranged to divert pressurized fluid to the ejector ram 12 for ejecting refuse from the storage compartment.

The third valve 82 operates the rams 55, 64 for loading and compaction of refuse in the tailgate portion. This valve includes a spool portion having three positions of adjustment. The valve is shown in FIG. 6 in a neutral position. When the valve is shifted to the right as shown in FIG. 6, a spool portion A of the valve 82 directs pressurized fluid from the main conduit 76 through a check valve 86 to a fluid feed conduit 88. The feed conduit has branch lines 90, 92 which communicate with the rod ends of the rams 64 and the head ends of the rams 55, respectively. When the plate 60 is positioned across the opening 41, as shown in FIG. 2, displacement of the valve 82 to position A causes the piston rods of the rams 64 to be urged toward a retracted position. When the rods of the rams 64 are in a fully retracted position (FIG. 2), pressure builds up in the branch line 92 causing a relief valve 94 to open and communicate the rod end of the rams 55 with the head ends thereof. Due to the greater piston area at the head ends of the rams 55, the forces tending to extend the rams 55 are greater than the retracting forces, and the rams 55 extend. Fluid from the rod ends of the rams 55 travels to the head ends thereof. In this manner, the loading assembly 47 is swung from the position of FIG. 2 to the position of FIG. 5*a* wherein refuse is crushed against the surfaces 44 and 46 of the hopper.

When the loading assembly 47 reaches the position shown in FIG. 5*a*, its motion is stopped automatically by a cycle-interrupt mechanism before an outer edge 95 of the packer plate 60 sweeps across the edge 45 of the sill 30. Perferably, the packer plate 60 is halted about twelve or thirteen inches above the edge 45. A portion of the cycle-interrupt mechanism is shown in FIGS. 4*a*–4*d*. Disposed exteriorly of one of the side walls 18 of the tailgate 14 is a pivoted manually actuable control handle 110 (FIG. 3) which is coupled to a connecting rod 112 (FIGS. 2 and 4*a*). The connecting rod 112 extends upwardly along the side of the tailgate 14 and is connected to a lever arm 114. The lever arm is rigidly connected to a pin 116 which extends through a bearing hole in the side 18 of tailgate 14. In this manner the pin 116 mounts the lever arm 114 for rotary movement. Rigidly fastened to the inner end of the pin 116 is a plate 118. At one end this plate 118 is pivotably coupled to a bar 120, and a the other end the plate 118 carries an adjustment abutment 122 in the form of a bolt.

As will be discussed later in detail, this abutment 122 is arranged so as to be automatically acted upon by a cycle-interrupt finger 124 which is secured to the cylinder section of one of the rams 55. Thus, during a first stage of the loading cycle (FIGS. 5*c* to 5*a*), the rams 64 are retracted to pivot the packer plate 60 to a horizontal position, and the rams 55 are extended to pivot the entire loading assembly downwardly. In so doing, the ram 55 pivots slightly, (counterclockwise as viewed in FIG. 4*a*) thereby displacing the finger 124 toward the abutment 122. Eventually, the finger 124 shifts the abutment 122 to automatically halt the movement of the plate assembly before the packer plate 60 transverses the edge 45 of the sill 30, as will be explained subsequently.

It will be understood that manual rotation of the control handle 110 by a workman produces up and down movement of the coupling rod 112 which, in turn, serves to rotate the plate 118. When the control handle 110 is rotated upwardly, the bar 120 is translated in a first direction (i.e., to the left as viewed in FIG. 4*a*). The bar 120 is guided within a sleeve 126 that is oversized to accommodate for a slight downward movement of the front end of the bar 120. Rigidly affixed to the bar 120 are a pair of flanges 128 which rotatably carry a roller 130, therebetween. A control rod 132 is rigidly coupled to the flanges 128 for translationed movement with the bar in a common direction. The other end of the control rod 132 is connected to the valve 82 (FIG. 6) to translat the latter. The spool part of the valve 82 includes a plurality of notches 134' which are engageable with a suitable projection (not shown) to retain the spool in its various positions of adjustment until shifted by the control rod 132.

A microswitch 134 having a pivotable actuating arm 136 is mounted adjacent the control rod 132 such that the end of the arm 136 bears against the control rod 132. The microswitch is operable to regulate the throttle of the vehicle engine in a conventional manner. Accordingly, during actuation of the rams 55, 64 the switch becomes closed, to increase engine speed. As a result, the speed of the pump motor 74 is increased sufficiently to provide ample pressure to operate the rams 55, 64. The microswitch 134 can be coupled to actuate the throttle in numerous conventional ways. For example, the microswitch, when closed, can serve to activate a solenoid which regulates a valve controlling the delivery of pressurized air from an air brake system to a ram which operates the throttle. A notch 140 is formed in the control rod 132 to receive the end of the arm 136 and thereby open the microswitch when the valve 82 is in a neutral position. When the control rod 132 is shifted in one direction or the other, the arm 136 is displaced from the notch 140 to close the microswitch and activate the engine throttle.

Figure 4C:
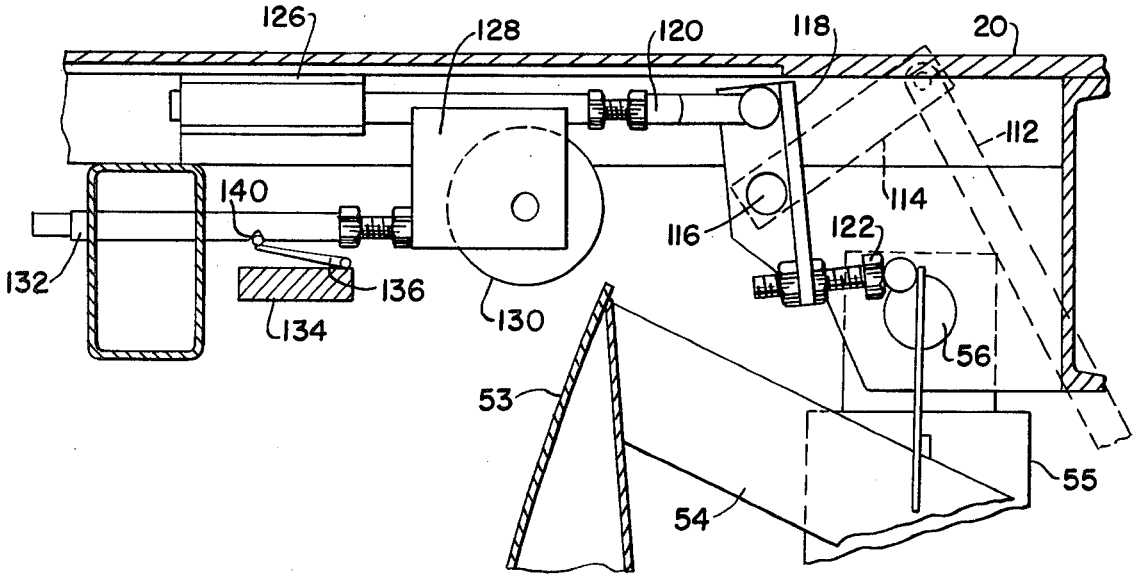
Figure 4A:
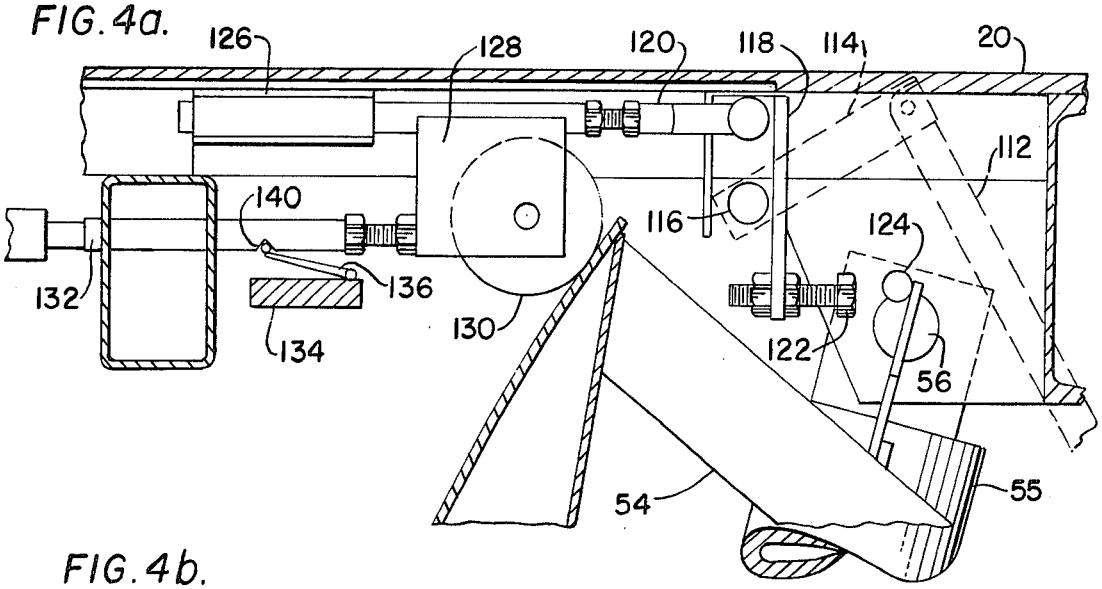
Figure 4B:
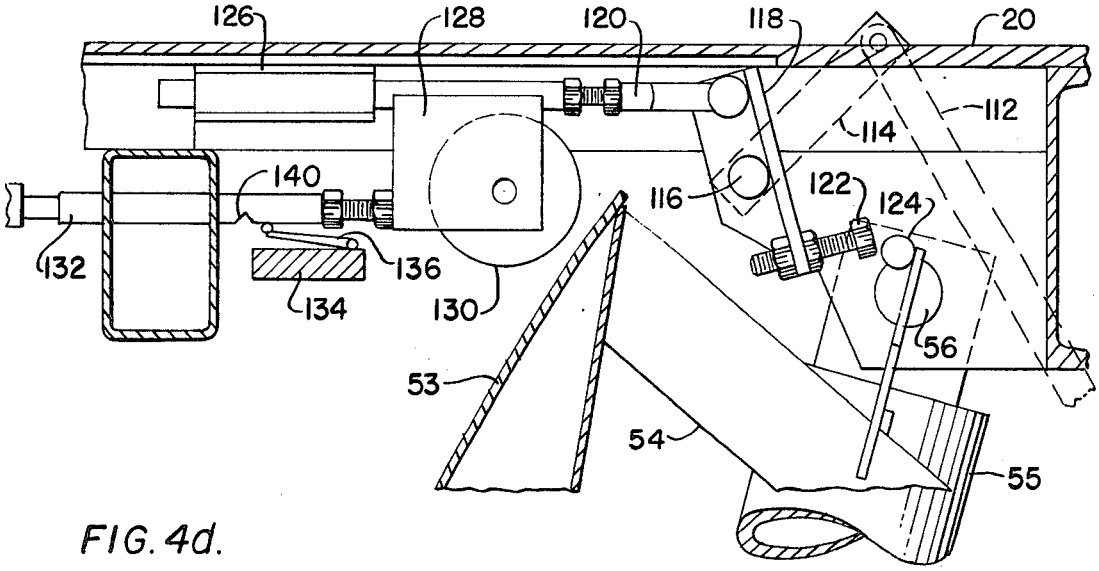
Figure 4D:
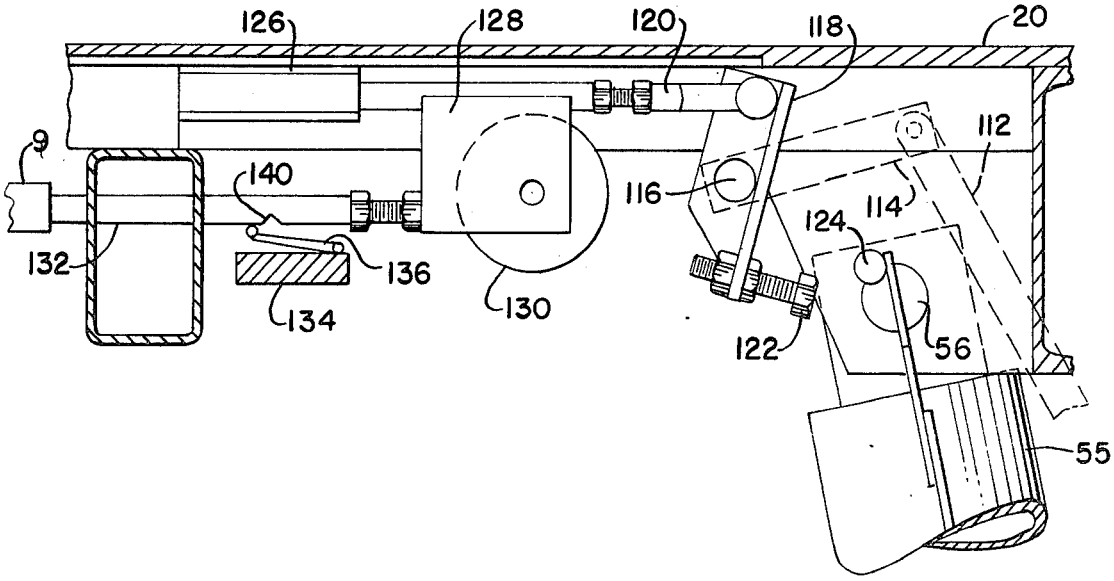

In this connection, movement of the control rod 132 to its cycle-continue position, i.e., to the right as viewed in FIG. 4*c*, is prevented by engagement between the roller 130 and the shield plate 53 when the latter is in an upward position as shown in FIG. 4*a*. Following movement of the loading assembly 47 through a first phase of its loading cycle (FIGS. 2 to 5*a*), movement of the control rod 132 to the cycle-continue position is permitted, as will be discussed.

Subsequent manual actuation of the valve 82 to the cycle continue position (i.e., to the left as depicted in FIG. 6) results in portion B of the valve 82 conducting pressurized fluid to a feed line 96. This feed line branches into lines 98 and 100 leading to the head ends of the rams 64 and the rod ends of the rams 55, respectively. Fluid from the branch line 98 causes the rams 64 to extend, thereby pivoting the packer plate 60 about the shafts 58 (FIGS. 5*a* to 5*b*). Refuse is thereupon further crushed against the surface 46 of the hopper 42.

When the rams 64 have been fully extended, pressure builds up in the branch line 100 sufficiently to open a relief valve 102. Pressurized fluid is thereupon directed to the rod ends of the rams 55. Fluid in the line 100 opens a pilot actuable check valve 104 in the branch line 92 by means 106 that is conventional in the art, such as a mechanical lever arrangement. As a result, the head ends of the rams 55 communicate with the reservoir 70 through lines 92, 88, valve 82, and line 88. As the rams 55 are retracted, the shield plate 53 and the packer plate 60 are displaced toward the discharge opening 41, with the packer plate 60 being swept across the surface 46 of the hopper (FIGS. 5*b* to 5*c*). In this manner, the compacted refuse is loaded into the storage compartment 9.

OPERATION

During a hopper filling phase of operation, the loading assembly 47 is oriented with the shield plate 53 disposed adjacent the wall and with the packer plate 60 disposed in a generally vertical position in front of the opening 41, as depicted in FIG. 5*c*. During this period, refuse can be deposited into the hopper 42 through the receiving opening 32. When a sufficient load of refuse has accumulated with the hopper 42, a workman initiates the loading cycle of the loading assembly by pivoting the handle 110 at the side of the vehicle upwardly. This action, in turn, serves to pivot the plate 118 counterclockwise and translate the control rod 132 to the left, as viewed in FIG. 4*b*.

The presence of the shield plate 53 against the roller 130 prevents movement of the handle 110 in a downward position. Hence, rotation of the handle 110 in the proper direction is assured.

Translation of the control rod 132 to its cycle-initiate position (FIG. 4*b*) closes the microswitch 134 to increase the output pressure of the fluid pump 72, and shifts the load-control valve 82 to its cycle-initiate position, wherein portion A of the valve spool is shifted to an operational position. Consequently, the rod sides of the rams 64 are pressurized, causing the rams 64 to retract and swing the packer plate 60 to a horizontal position (see solid line position of FIG. 2). Subsequently, pressure builds up in the branch line 92, causing the relief valve 94 to open so that the rams 55 are extended to pivot the loading assembly 47 downwardly as depicted in FIG. 5*a*. The packer plate 60 remains in a generally horizontal position due to pressurization of the rod ends of the rams 64. During this movement the packer plate 60 crushes and compacts refuse in the hopper 42 against the surfaces 44, 46.

As the loading assembly 47 descends (to the FIG. 5*a* position), thee rams 55 pivot about the pins 56 (in a counterclockwise direction as viewed in FIGS. 2, 4*c*), thereby swinging the cycle-interrupt finger 124 toward the abutment 122. When the packer plate 60 reaches a pre-selected height above the sill 30, such as about thirteen inches, the finger 124 automatically engages and rotates the plate 118 (in a clockwise direction as viewed in FIG. 4*c*) to translate the control rod 132 (to the right as viewed in FIG. 4*c*). Accordingly, the control rod 132 shifts the load-control valve 82 to a neutral position and movement of the loading assembly 47 stops. At this point the operator can check to determine if there is any problem in continuing the cycle. If no such problem exists, the operator pivots the handle 110 downwardly, thereby shifting the control rod 132 to the right as viewed in FIG. 4*c*. Since the shield plate 53 has been displaced to a position remote from the roller 130, such shifting of the control rod is permitted. The spool of the load-control valve 82 is thus shifted to bring portion A of the valve spool into operating position. Fluid is then supplied to the head ends of the rams 64 to pivot the packer plate forwardly to again crush and compact the refuse against the surface 46 of the hopper (FIG. 5*b*).

When the rams 64 are fully extended, fluid pressure in the branch line 100 opens the relief valve 102 and the check valve 104 and, consequently, the rams 55 are retracted. At the same time, full pressure is maintained at the head ends of the rams 64. As a result, the shield plate 53 and the packer plate 60 are displaced toward the discharge opening 41 to push the compacted refuse into the storage compartment 9 (FIG. 5*c*).

The shield plate 53 travels upwardly during this operation and eventually contacts the roller 130 to translate the control rod 132 and the load-control valve 82 to a neutral position (FIG. 4*a*). Hence, the loader 47 is automatically stopped in the position depicted in FIG. 5*c*.

By virtue of the present invention, a rear end loader can be operated under highly safe working conditions. That is, since the packer plate 60 automatically comes to a complete stop before traversing the sill 30 and cannot be moved without further workman attention, conditions which might otherwise result in injury can be detected and prevented.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A refuse collection vehicle comprising:

a rear hopper having an inlet into which refuse is dumped by an operator, a packer plate for compacting refuse in said hopper, power means connected to said packer plate for displacing said packer plate through a loading cycle wherein refuse in said hopper is compacted within the hopper, and cycle interrupt means automatically responsive to the arrival of said packer plate at a predetermined location in said cycle relative to said hopper prior to full compaction of the refuse for deactivating said power means, and manually actuable means for reactivating said power means to continue said loading cycle subsequent to such deactivation.

2. A refuse collection vehicle according to claim 1 wherein said manually actuable means includes a lever on the outside of said hopper adjacent said hopper inlet.

3. A refuse collection vehicle comprising:

a refuse storage compartment;

a tail section including:

a refuse receiving hopper having a transverse rear edge, a rear inlet above said edge for introduction of refuse into said hopper, and a front outlet communicating said hopper with said storage compartment.

refuse loading means displaceably mounted in said tail section, said loading means including a packer plate;

power means operably connected to said loading means for displacing said loading means through a refuse loading cycle in which said packer plate compacts refuse within said hopper and expels such refuse through said outlet and into said storage compartment;

said power means including manually actuable cycle activating means; and cycle interrupt means automatically responsive to the arrival of said packer plate at a predetermined position in said loading cycle for deactivating said power means to discontinue said loading cycle before said packer plate transverses said transverse hopper edge, and maintain said power means deactivated in the absence of manual reactivation.

4. Apparatus according to claim 3 wherein said cycle interrupt means is arranged to deactivate said power means in response to arrival of said packer plate at a preselected height above said transverse edge.

5. Apparatus according to claim 3 wherein said power means comprises fluid-powered ram means, fluid pressurizing means, valve means for directing pressurized fluid to said ram means, and control linkage, including said manually actuable cycle-activating means, for shifting said valve means; said cycle interrupt means being mounted for movement in response to operation of said ram means to engage said control linkage and shift said valve means to a neutral position.

6. Apparatus according to claim 5 wherein said control linkage comprises an abutment member which is engaged by said cycle interrupt means, said abutment member being adjustable to vary the point in the cycle where interruption occurs.

7. Apparatus according to claim 5 wherein said control linkage is manually shiftable in a first direction to initiate said cycle and is shiftable in a second direction to continue said cycle subsequent to interruption thereof; said loading means including means for preventing movement of said control linkage in said second direction prior to initiation of said cycle and for shifting said control linkage to a neutral position in response to completion of said loading cycle.

8. Apparatus according to claim 7 wherein said loading means comprises said packer plate, a shield plate, and arm means mounting said shield plate for rotation about a first axis; said packer plate being pivotable relative to said shield plate about a second axis; said shield plate comprising said means for preventing movement of said control linkage prior to cycle initiation and said means for shifting said control linkage at the completion of a loading cycle.

9. Apparatus according to claim 8 wherein said control linkage includes a manually rotatable handle on said tail section, a control rod connected to said valve means, and means interconnecting said handle and said control rod for converting rotary movement of said handle into translational movement of said control rod.

10. Apparatus according to claim 9 wherein said interconnecting means includes a roller arranged for engagement by said shield plate to prevent movement of said control rod in said second direction and to shift said valve means to a neutral position at the end of a cycle.

11. Apparatus according to claim 10 wherein said ram means comprises first rams for rotating said loading means, and second rams for rotating said packer plate relative to said shield plate; said cycle interrupt means comprising a finger mounted on one of said first rams.

12. In rear loader vehicle apparatus of the type comprising: a housing having a compartment; a hopper with a refuse support surface, a refuse receiving opening disposed above a rear edge of the hopper, and a refuse discharge opening at a front end of the hopper for transferring refuse from the hopper into the compartment; a refuse loading mechanism including a shield plate pivotally mounted to said housing for rotation about a first axis, and a packer plate movable with said shield plate about said first axis and pivotable relative to said shield plate about a second axis; and cycle activating means for displacing said loading mechanism through a refuse loading cycle, the improvement wherein said cycle activating means comprises:

first fluid powered ram means operably connected to said loading mechanism for pivoting said shield plate and said packer plate about said first axis;

second fluid powered ram means operably connected to said packer plate for pivoting said packer plate about said second axis;

ram actuating means for directing pressurized fluid to said first and second ram means to automatically and sequentially:

actuate said second ram means to retract said packer plate about said second axis away from said compartment;

actuate said first ram means to pivot said shield plate and said packer plate rearwardly and downwardly about said first axis to compact refuse in said hopper against said support surface, subsequently reactuate said second ram means to pivot said packer plate forwardly about said second axis and again compact the refuse against said support surface, and subsequently reactuate said first ram means to pivot said shield plate and said packer plate upwardly and forwardly about said first axis to expel the compacted refuse through said discharge opening and into said compartment;

control means operably connected to said ram actuating means and including a manually actuable handle on said vehicle body for activating said cycle, and cycle interrupt means mechanically connected to said refuse loading mechanism for operating said control means during said loading cycle prior to said reactuation of said first ram means to halt said cycle prior to said packer plate traversing said hopper rear edge and maintain said cycle halted in the absence of manual actuation of said handle.

13. In a method of loading refuse into a rear end loader vehicle in which an operator dumps refuse over a rear transverse edge of said vehicle and into a hopper portion of the vehicle and subsequently manually activates a power system on the vehicle which displaces a packer plate through a loading cycle within the hopper in which the packer plate travels downwardly past said transverse edge, compacts the refuse in the hopper, and transfers the refuse from the hopper to a storage portion of the vehicle, the improvement comprising the steps of:

causing said power system to be automatically deactivated solely in response to the arrival of said packer plate at a predetermined position above said transverse edge and independently of manual activation of said power system, and maintaining said power system deactivated in the absence of manual reactivation by an operator.

* * * * *